US008203273B1

(12) United States Patent
Xiong et al.

(10) Patent No.: US 8,203,273 B1
(45) Date of Patent: Jun. 19, 2012

(54) BALLAST CIRCUIT FOR A GAS DISCHARGE LAMP THAT REDUCES A PRE-HEAT VOLTAGE TO THE LAMP FILAMENTS DURING LAMP IGNITION

(75) Inventors: Wei Xiong, Madison, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 441 days.

(21) Appl. No.: 12/464,653

(22) Filed: May 12, 2009

Related U.S. Application Data

(60) Provisional application No. 61/168,876, filed on Apr. 13, 2009.

(51) Int. Cl.
*H05B 41/14* (2006.01)

(52) U.S. Cl. ..... 315/94; 315/97; 315/106; 315/107; 315/116

(58) Field of Classification Search ..... 315/94–97, 315/105–107, 112–119
See application file for complete search history.

(56) References Cited

U.S. PATENT DOCUMENTS 4,818,917 A 4/1989 Vest
5,444,333 A 8/1995 Lau
5,563,473 A 10/1996 Mattas et al.
5,583,399 A 12/1996 Rudolph
5,801,491 A * 9/1998 Canova ..... 315/224
5,877,592 A 3/1999 Hesterman et al.
5,959,408 A 9/1999 Steel et al.
6,348,769 B1 * 2/2002 Pinchuk et al. ..... 315/307
6,501,225 B1 * 12/2002 Konopka ..... 315/105
6,664,742 B2 12/2003 Venkatraman et al.
6,933,684 B2 8/2005 Yang et al.
7,187,132 B2 * 3/2007 Bakre ..... 315/94
7,218,060 B1 5/2007 Lin et al.
7,560,868 B2 * 7/2009 Yu et al. ..... 315/94
7,728,528 B2 * 6/2010 Chan et al. ..... 315/224
7,923,942 B1 * 4/2011 Xiong et al. ..... 315/308
2003/0076055 A1 4/2003 Hooijer et al.
2007/0262734 A1 11/2007 Vekat et al.

* cited by examiner

*Primary Examiner* — Jason M Crawford
(74) *Attorney, Agent, or Firm* — Waddey & Patterson, P.C.; Mark J. Patterson; Gary L. Montle

(57) ABSTRACT

A ballast circuit includes a filament cutback circuit to reduce a pre-heat voltage after the lamp filaments have been pre-heated. The filament cutback circuit includes a filament cutback inductive component magnetically coupled to the resonant inductive component in the inverter to receive a filament cutback control voltage associated with an AC voltage for powering the lamps. During the pre-heating period, the filament cutback control voltage is not high enough to charge a chargeable component to a switch threshold level. However, during lamp ignition, the filament cutback control voltage is increased and charges the chargeable component to the switch threshold level. This causes a switch device to operate in a conductive switch state and the filament cutback circuit suppresses the pre-heat voltage.

9 Claims, 3 Drawing Sheets

BALLAST CIRCUIT FOR A GAS DISCHARGE LAMP THAT REDUCES A PRE-HEAT VOLTAGE TO THE LAMP FILAMENTS DURING LAMP IGNITION

CROSS-REFERENCES TO RELATED APPLICATIONS

This application claims benefit of the following patent application(s) which is hereby incorporated by reference: U.S. Provisional Application No. 61/168,876, filed Apr. 13, 2009, entitled "Ballast Circuit for a Gas Discharge Lamp that Reduces a Pre-Heat Voltage to the Lamp Filaments During Lamp Ignition."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Pre-heating lamp filaments helps extend the life of gas-discharge lamps. Furthermore, the pre-heating of lamp filaments may be necessary to ignite certain types of high impedance gas-discharge lamps, such as the T5 model gas-discharge lamp. During a pre-heat period, ballast circuits may be coupled to pre-heat components to transmit pre-heat voltages to the lamp filaments of gas-discharge lamps 16.

Referring now to FIG. 1, one example of a prior art ballast circuit 1 is shown. Half-bridge class D inverters are commonly used to operate high-impedance gas discharge lamps because of their efficiency and relatively inexpensive design. The ballast circuit 1 in FIG. 1 utilizes a half-bridge Class D inverter 3 to power two high impedance gas-discharge lamps 4, such as the T5 model gas discharge lamps. Inverter 3 converts a DC voltage from V_rail into an AC voltage that powers high impedance gas-discharge lamps 4. To convert the DC voltage into the appropriate AC voltage, the inverter 3 utilizes inverter drive circuit (not shown) and switches Q1, Q2 to convert the DC voltage into a pulsed voltage. DC blocking capacitor, C_dc_block, blocks the DC components of the pulsed voltage. In cooperation with resonant circuit 5, the pulsed voltage is converted into an AC voltage having the appropriate frequency for operating the gas discharge lamps 4.

To pre-heat the lamp filaments 4A of gas-discharge lamps 4, the inductive component L_resonant of the resonant circuit 5 is magnetically coupled to secondary windings 7. During the pre-heat period, inverter 3 is operated at a high switching frequency, well above the resonant frequency of the resonant circuit 5. Consequently, a relatively low AC voltage is generated by the inverter 3 and an associated pre-heat voltage is coupled from the inductive component 6 to each of the secondary windings 7.

Unfortunately, while ballast circuit 1 is very useful to operate high impedance gas-discharge lamps 4, the pre-heat voltage continues to be coupled to the lamp filaments 4A after the lamp filaments 4A have been ignited. This reduces the efficiency of ballast circuit 1 during steady state operation and may cause an over current problem. This is particularly troublesome for high impedance lamps which are particularly sensitive to over-current problems.

The prior art ballast circuit 1 utilizes capacitors C1, C2, and C3 to reduce the magnitude of the pre-heat voltage during steady state operation. However even then, the pre-heat voltage causes unacceptable inefficiencies and lamp pin current problems when operating high impedance gas-discharge lamps 4. Furthermore, the selection of capacitance values for capacitors C1, C2, and C3 requires a delicate balance between providing a pre-heat voltage at a high level during the pre-heat period to pre-heat the filaments 4A and maintaining the pre-heat voltage at a low level during steady-state operation to not cause over-current problems. This makes the sizing of capacitors C1, C2, and C3 particularly difficult and sometimes impractical.

The prior art solves this problem by coupling the prior art ballast circuit 1 to expensive filament shutdown circuits which significantly increase the cost of the ballast circuit 1.

What is needed, then, is a filament cutback circuit that will reduce the pre-heat voltage to the lamp filament after lamp ignition without significantly increasing the cost of the ballast circuit.

BRIEF SUMMARY OF THE INVENTION

This invention is directed to a ballast circuit that reduces a pre-heat voltage to lamp filaments of gas discharge lamps after the lamp filaments have been pre-heated. The ballast circuit does not require expensive electronic components and is capable of reducing the pre-heat voltage to acceptable levels during steady state operation.

The ballast circuit may include an inverter with switch devices that convert a DC voltage into a pulsed voltage. A resonant circuit filters the pulsed voltage into the required AC voltage for powering the gas-discharge lamps. A pre-heat circuit is coupled to transmit a pre-heat voltage to the lamp filaments. The pre-heat circuit may include a primary pre-heat winding coupled to a resonant inductive component to receive the pre-heat voltage and may be magnetically coupled to secondary pre-heat windings which couple the pre-heat voltage to the lamp filaments of the gas-discharge lamps.

After the lamp filaments have been pre-heated, the ballast circuit attempts to ignite the lamps. A filament cutback circuit senses the ignition of the lamps and suppresses the pre-heat voltage during steady-state operation. To accomplish this, the filament cutback circuit may include a cutback circuit inductive component magnetically coupled to the resonant inductive component and receive a filament cutback control voltage associated with the AC voltage. This filament cutback control voltage charges a chargeable component to a switch threshold level during lamp ignition. Once the chargeable component reaches the switch threshold level, a switch device may be placed into a conducting switch state which causes the filament cutback circuit to reduce the pre-heat voltage. The chargeable component may be maintained above the switch threshold level during steady state operation. In this manner, the filament cutback circuit suppresses the pre-heat voltage after pre-heating the lamp filaments to eliminate the inefficiencies caused by the over current pin problem during steady state operation.

DETAILED DESCRIPTION OF THE INVENTION

Figure 1:
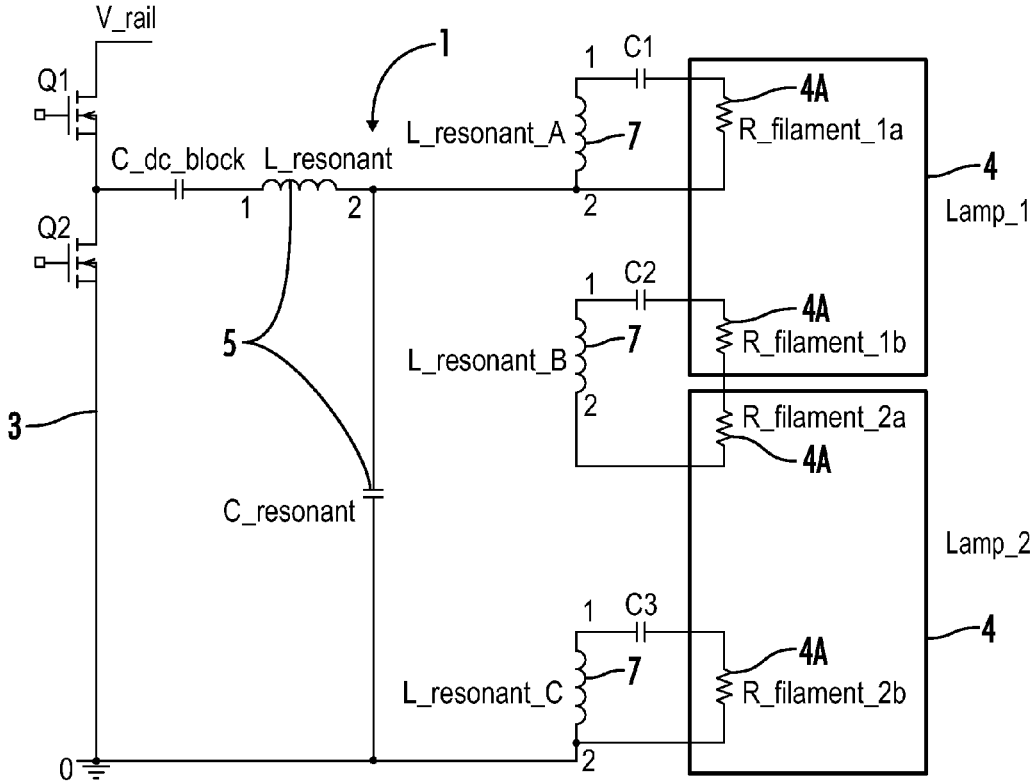
FIG. 1 (PRIOR ART)
FIG. 1 is a schematic of a prior art embodiment of a ballast circuit for pre-heating the lamp filaments of two gas discharge lamps.
Figure 2:
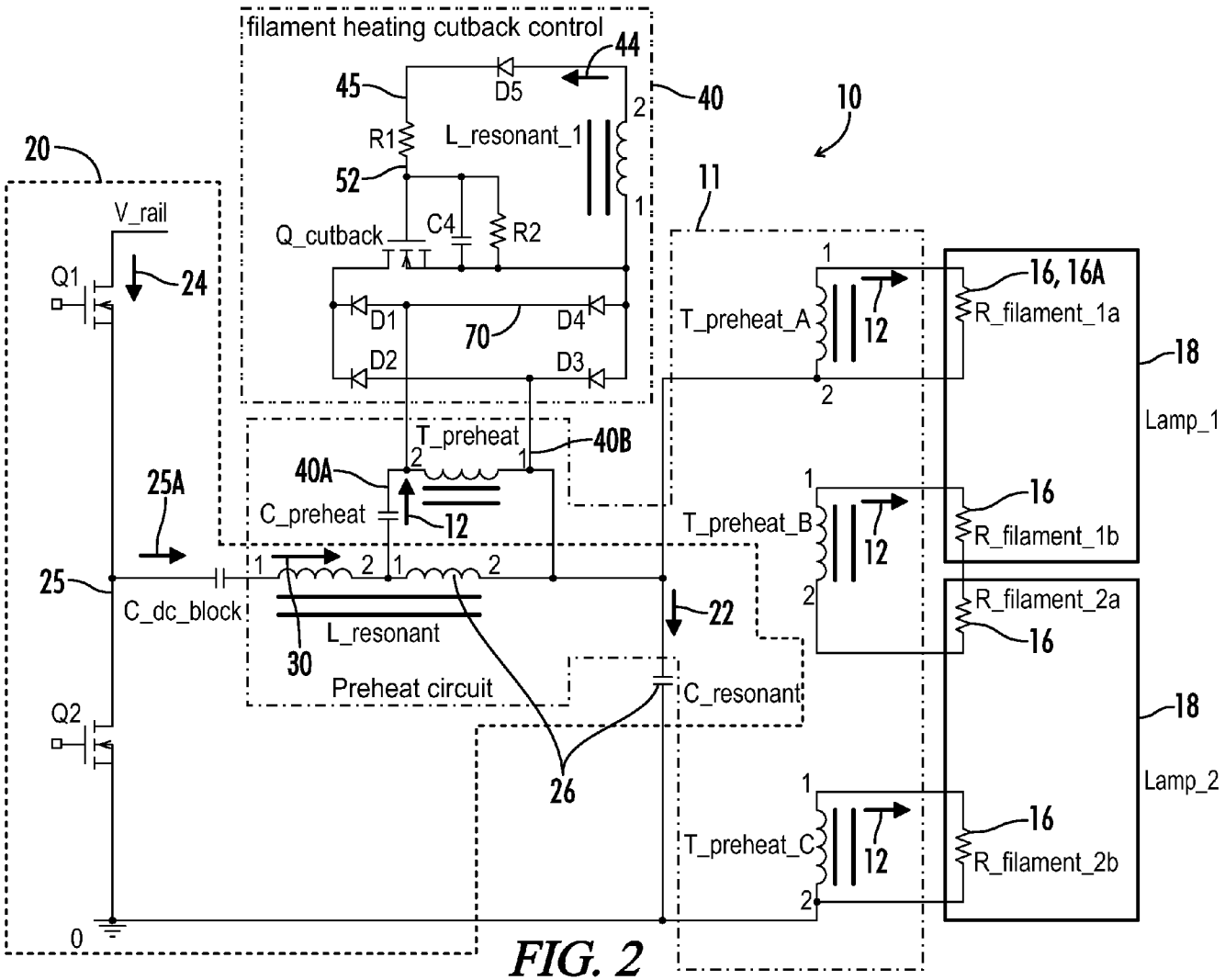
FIG. 2 is a schematic of one embodiment of a ballast circuit in accordance with the invention having a first embodiment of the filament cutback circuit.

Referring now to FIG. 2, a ballast circuit 10 in accordance with the present invention is shown. The ballast circuit 10 has an inverter 20 which in FIG. 2 is arranged in a half-bridge Class D inverter topology. However, it should be understood that the invention may be embodied in other inverter circuits that may be utilized to pre-heat lamp filaments 16, and with any type of gas discharge lamp. The invention suppresses a pre-heat voltage 12 after the lamp filaments 16 have been pre-heated and does not require a particular inverter or a particular lamp design to function. A half-bridge Class D inverter topology is illustrated because this inverter topology is commonly used to power high-impedance gas discharge lamps which are particularly sensitive to over current pin problems during steady-state operation. The invention is particularly useful in solving this problem. In addition, the invention may be utilized with lamps that are not high impedance gas discharge lamps.

Inverter 20 receives a DC voltage 24 at V_rail and converts the DC voltage 24 into an AC voltage 22 that powers the lamps 18. Inverter 20 utilizes an inverter drive circuit (not shown), inverter switch devices, Q1, Q2, and a resonant circuit 26 that includes a resonant inductive component, L_resonant, and a capacitive resonant component C_resonant. Resonant circuit 26 may be tuned to the appropriate frequency for powering the gas discharge lamps 18. In this particular embodiment, the resonant circuit 26 is coupled between the inverter switches Q1, Q2 at terminal 25. As is known in the art, inverter switches Q1, Q2 are switched at a switching frequency to generate a pulsed voltage 25A.

DC blocking capacitor, C_dc_block, blocks the DC components of the pulsed voltage 25A. Resonant circuit 26 then filters the pulsed voltage 25A to provide an AC voltage 22 at the appropriate frequency for powering the gas discharge lamps 18.

To pre-heat the lamps 18, a pre-heat voltage 12 is received by the lamp filaments 16. In this embodiment, the lamp filaments 16 are connected in series. As shown in FIG. 2, the invention reduces the pre-heat voltage 12 after the lamp filaments 16 have been pre-heated, without the need for the steady state capacitors or filament shutdown circuits as used in the prior art. The signal level reduced by the ballast circuit 10 may be any type of signal level associated with the pre-heat voltage 12, including a voltage, current, or power level. The signal level reduced by the ballast circuit 10 may be interrelated or independent of other levels associated with the pre-heat voltage 12 and may depend on the particular application of the invention.

During the pre-heat period, the pre-heat circuit 11 receives the pre-heat voltage 12 from the resonant inductive component 28 in the inverter 20. Consequently, the pre-heat voltage 12 is associated with a voltage across the resonant inductive component L_resonant, and is related to AC voltage 22. Upon receiving the pre-heat voltage 12, the pre-heat circuit 11 couples the pre-heat voltage 12 to the lamp filaments 16, utilizing a pre-heat component which in this embodiment is primary pre-heat winding, T_preheat. Secondary pre-heat windings T_preheat_A, T_preheat_B, and T_preheat_C, are magnetically coupled to primary pre-heat winding T_preheat to receive pre-heat voltage 12. Secondary pre-heat windings T_preheat_A, T_preheat_B, and T_preheat_C are coupled to the lamp filaments 16 which are pre-heated by the pre-heat voltage 12.

A control circuit (not shown) may be utilized to control the switching frequency of switches, Q1, Q2 in the inverter 20. When the inverter 20 is pre-heating the lamp filaments 16, the switching frequency is relatively high and away from the resonant frequency of resonant circuit 26. Accordingly, the AC voltage 22 is small and the pre-heat voltage 12 is coupled via primary pre-heat winding T_preheat to secondary pre-heat windings T_preheat_A, T_preheat_B, and T_preheat_C. A pre-heat capacitor, C_preheat, is provided between the resonant inductive component L_resonant and the primary pre-heat winding, T_preheat, so that the pre-heat voltage 12 is substantially constant during the pre-heat period. Pre-heat capacitor C_preheat is also provided to keep the pre-heat voltage 12 to the primary pre-heat winding, T_preheat, relatively low. This allows a reduction in the size of the ballast circuit 10 which helps reduce cost.

A filament cutback circuit 40 may be coupled across the primary pre-heat winding, T_preheat. Filament cutback circuit 40 includes a switch control circuit 45 that receives a filament cutback control signal 44 utilizing a cutback circuit inductive component, L_resonant_1, magnetically coupled to the resonant inductive component, L_resonant. Filament cutback control signal 44 charges a chargeable component, which in this case, is capacitor C4. Resistors R1, R2 behave as a voltage divider so that the voltage level of filament cutback control signal 44 is maintained at a desired level across the capacitor C4.

Filament cutback control signal 44 is associated with the AC voltage 22, and may even be the AC voltage 22 itself. In addition, filament cutback control signal 44 may lead or lag the AC voltage 22 and may have different voltage levels than the AC voltage 22. However, the voltage level of the filament cutback control signal 44 should follow the same pattern as the level of the AC voltage 22 to the filament cutback circuit 40 and may be the AC voltage 22 itself. In this embodiment, the filament cutback control signal 44 is related to a voltage 30 across the resonant inductive component, L_resonant. The voltage level of the filament cutback circuit 40 can also be controlled via the turns ratio from the resonant inductive component, L_resonant, and cutback circuit inductive component, L_resonant_1. This helps assure that low voltage components can be utilized by the ballast circuit 10 and reduces the cost of the filament cutback circuit 40.

Upon receiving the filament cutback control signal 44 from the resonant inductive component, L_resonant, a rectifying diode D5 transmits only a single half-cycle of the filament cutback control signal 44 which charges the capacitor C4. In the illustrated embodiment, diode D5 is a fast switching diode. During the non-charging half cycle of the filament cutback control signal 44, the capacitor C4 may at least partially discharge through resistor R2.

Capacitor C4 is coupled to the switch device, Q_cutback, at switch state input terminal 52. A charging characteristic of the chargeable component is selected so that the chargeable component does not reach a switch threshold level during the pre-heat period. In this case, the charging characteristic is the capacitance value of capacitor C4.

During the pre-heat period, the switch device 40 is off and therefore does not inhibit the coupling of the pre-heat voltage 12 to the secondary pre-heat windings T_preheat_A, T_preheat_B, and T_preheat_C. After the pre-heat period, ballast circuit 10 ignites the gas discharge lamps 18. To accomplish this, the switching frequency of switches Q1, Q2 is lowered so that the AC voltage 22 operates at or above a lamp ignition power level. This causes filament cutback control signal 44 to be received at a high voltage level which charges capacitor C4 at or above the switch threshold level. Upon reaching the switch threshold level, the switch state input terminal 52 places the switch device, Q_cutback, into a conductive switch state and the primary pre-heat winding, T_preheat is shorted, thereby suppressing the pre-heat voltage 12 to the secondary pre-heat windings T_preheat_A, T_preheat_B, and T_preheat_C.

The capacitance of the capacitor C4 may be selected so that the switch device Q_cutback is maintained at or above the switch threshold level after lamp ignition and during steady-state operation. In this manner, the pre-heat voltage 12 to the lamp filaments 16 is reduced after lamp filaments 16 have been pre-heated. This operates a high impedance lamp 18, such as a T5 model gas-discharge lamp, with improved efficiency and reduces the pin current unbalance problem caused by the pre-heat voltage 12 during steady-state operation.

It should be understood however that other embodiments of the filament cutback circuit 40 may suppress the pre-heat voltage 12 when the switch device 40 is in a non-conducting switch state. For example, the switch device, Q_cutback, may be connected in series with the primary pre-heat winding, T_preheat, and suppress the pre-heat voltage 12 when turned off.

In addition, filament cutback circuit 40 may reduce the pre-heat voltage 12 when coupled to other pre-heat components utilized to couple the pre-heat voltage 12 to the lamp filaments 16. For example, if the filament cutback circuit 40 is coupled across secondary pre-heat winding, T_preheat_A, filament cutback circuit 40 suppresses the pre-heat voltage 12 to this individual lamp filament 16A.

In the embodiment of FIG. 2, the pre-heat circuit 11 includes a pre-heat transformer that has a primary pre-heat winding, T_preheat, magnetically coupled to secondary pre-heat windings, T_preheat_A, T_preheat_B, and T_preheat_C. Primary pre-heat winding, T_preheat and secondary pre-heat windings T_preheat_A, T_preheat_B, and T_preheat_C may form a part of a pre-heat transformer. This allows multiple lamp filaments 16 to be pre-heated at the same time by a single primary pre-heat winding, T_preheat while isolating the secondary pre-heat windings T_preheat_A, T_preheat_B, and T_preheat_C, from the inverter 20. Furthermore, filament cutback circuit 40 can suppress the pre-heat voltage 12 to multiple lamps, 18 by controlling the pre-heat voltage 12 across the primary pre-heat winding, T_preheat. In this embodiment, the filament cutback circuit 40 controls the pre-heat voltage 12 across the terminals, 40A, 40B, to suppress the pre-heat voltage 12 across primary pre-heat winding, T_preheat.

However, the use of a primary pre-heat winding, T_preheat, and secondary pre-heat windings T_preheat_A, T_preheat_B, and T_preheat_C, are not required for the operation the filament cutback circuit 40. For example, if the ballast circuit 10 is coupled to a single lamp filament 16A in a solitary lamp, then the secondary pre-heat windings, T_preheat_A, T_preheat_B, and T_preheat_C, of the solitary lamp 18 may be magnetically coupled to resonant inductive component L_resonant instead of the primary pre-heat winding, T_preheat. Filament cutback circuit 40 could then be coupled across the secondary pre-heat winding at the solitary lamp filament 16A and would control the pre-heat voltage 12 across the single lamp filament 16A. In fact, filament cutback circuit 40 may be coupled to any pre-heat component in the pre-heat circuit 11 so long as filament cutback circuit 40 is arranged in a manner that reduces the pre-heat voltage 12 to a desired lamp filament(s) when the switch device, Q_cutback, is activated.

Referring again to FIG. 2, although the switch device, Q_cutback, is in a non-conducting state, this does not mean that there is no voltage drop across the component during the pre-heat period. Switch device, Q_cutback, may have a leakage current or voltage across the switch device, Q_cutback, when the switch device, Q_cutback, is in a non-conducting state. Therefore, rectifier 70 is provided so that any voltage that does reach the transistor during the pre-heat period does not damage the device. In this embodiment, rectifier 70 is a full bridge rectifier having diodes D1, D2, D3, and D4. Switch device, Q_cutback may be a transistor, such as an ordinary MOSFET or JFET. Other embodiments may utilize a Triac or mechanical switches to implement the invention.

To assure that low voltage components may be utilized with the filament cutback circuit 40, terminal 40A of the pre-heat circuit 11 may be coupled to a tap 72 on the resonant inductive component, L_resonant. This tap 72 is positioned on the resonant inductive component, L_resonant, such that the diodes, D1, D2, D3, D4 and switch device, Q_cutback may be low voltage components. The use of low voltage components helps reduce the cost of the filament cutback circuit.

The table below shows parameter values for one embodiment of the ballast circuit 10 in FIG. 2 that pre-heats the lamp filaments 16 to two T5 28 watt gas-discharge lamps 18.

| Component | Parameter | Value |
|---|---|---|
| Inverter | Switch Frequency During the Pre-heating Period | 100 KHz |
| Inverter | Switch Frequency During Steady State Operation | 58 Khz |
| Lamp | Lamp Current During Steady State Operation | 107 mA |
| DC Blocking Capacitor | Capacitance | 100 NF |
| Resonant Capacitor | Capacitance | 2.7 NF |
| Chargeable Component | Capacitance | 2.2 μH |
| Resonant Inductive Component | Inductance | 2.9 mH |
| Primary Pre-heat Winding | Inductance | 5 mH |
| R1, | Resistance | 2 MΩ |
| R2 | Resistance | 2 MΩ |
| Diodes of D1, D2, D3, and D4 | Type | 1 amp-400 volt diode |
| Switch Device | Type | 1 amp-400 volt MOSFET |
| (primary pre-heat winding)/(secondary pre-heat winding, T_preheat_A) | Turns Ratio | 25:1 |
| (primary pre-heat winding)/(secondary pre-heat winding, T_preheat_B) | Turns Ratio | 10:1 |
| (primary pre-heat winding)/(secondary pre-heat winding, T_preheat_C) | Turns Ratio | 25:1 |
| Resonant Inductive Component/Cutback Circuit Inductive Component | Turns Ratio | 100:1 |

By using the design parameters shown above, the pre-heat voltage 12 is approximately 8 volts during the pre-heat period and approximately 0.3 volts during steady-state operation. This 0.3 volt pre-heat voltage 12 is not coupled from the primary pre-heat winding, T_preheat, but instead is naturally caused by the lamp current during steady-state operation. The equivalent impedance of the filament cutback circuit 40 is approximately 10.6 k'Ω during the pre-heat period. This is relatively low when compared to previous filament shutdown circuit designs. The equivalent impedance is even smaller during steady state operation. Because of this relatively low impedance, the magnetic core coupling the primary pre-heat winding T_preheat and secondary pre-heat windings T_preheat_A, T_preheat_B, and T_preheat_C can be relatively small. This further reduces the cost of the ballast circuit 10.

Figure 3:
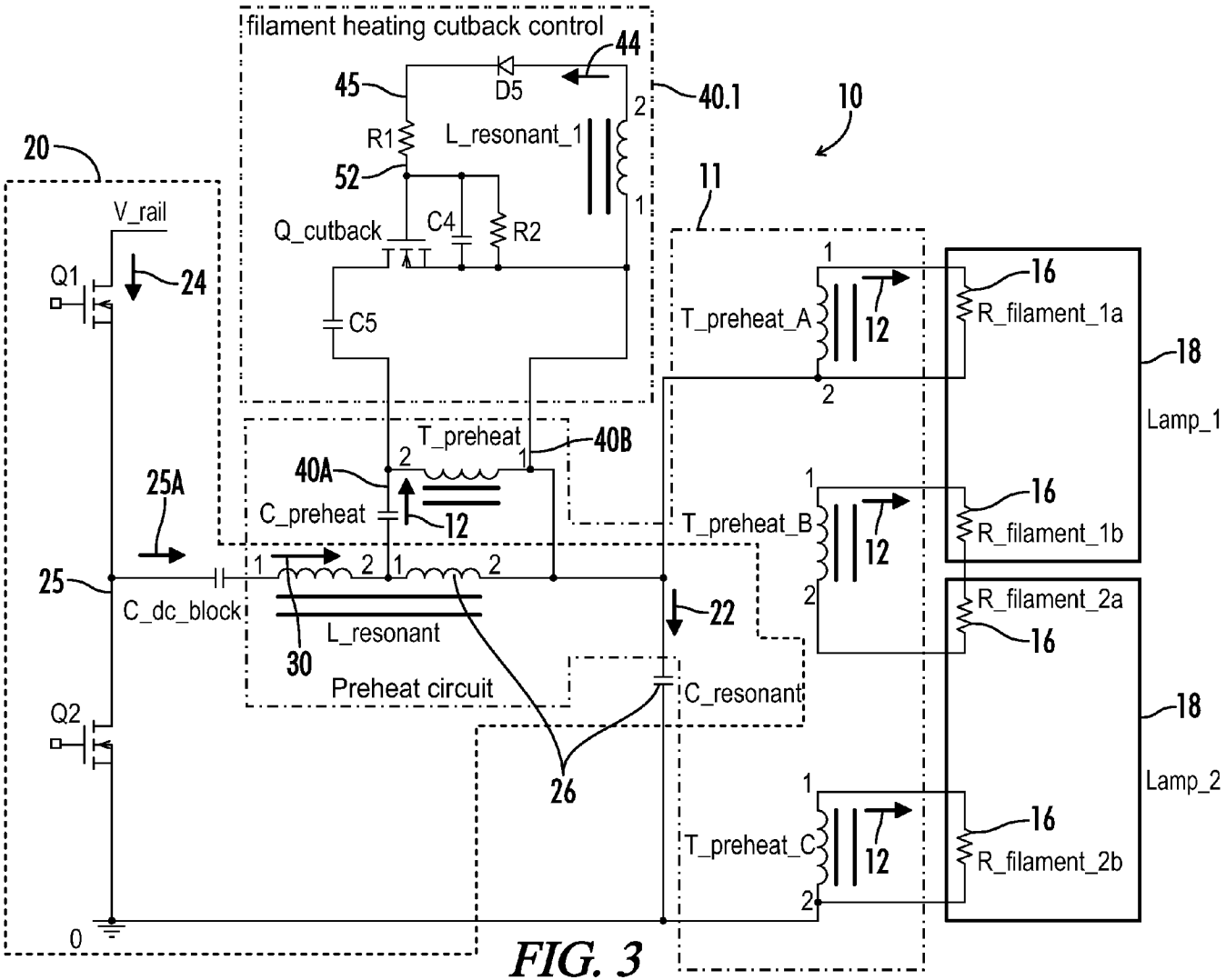
FIG. 3 is a schematic of the ballast circuit of FIG. 2 having a second embodiment of the filament cutback circuit.

Referring to FIG. 3, a second embodiment of the filament cutback circuit 40 is shown coupled across the primary pre-heating winding, T_preheat. This embodiment operates in the same manner as the first embodiment described above, except that the primary pre-heat winding, T_preheat is not shorted. Instead, a filament cutback circuit capacitor C5 is coupled between the primary pre-heat winding, T_preheat, and the switch device, Q_cutback. Filament cutback circuit capacitor has a relatively large capacitance with respect to pre-heat capacitor C_preheat. When the switch device, Q_cutback, is in the conducting switch state, pre-heat capacitor, C_preheat, acts as a first voltage drop component for the pre-heat voltage 12 and the filament cutback circuit capacitor C5 acts as a second voltage drop component for the pre-heat voltage 12. As illustrated, filament cutback circuit capacitor C5 and primary pre-heat winding are connected in parallel when the switch device, Q_cutback is on. Because filament cutback capacitor C5 is sized to be significantly larger than pre-heat capacitor C_preheat, most of the voltage drop of the pre-heat voltage 12 will drop across the pre-heat capacitor C_preheat. Only a small amount of voltage will drop across the filament cutback circuit capacitor C5.

Filament pre-heat voltage 12 is thus reduced whenever the switch device Q_cutback is placed into the conducting state. Filament cutback circuit capacitor C5 may have a capacitance value that is at least 50 times greater than the capacitance value of the pre-heat capacitor C_preheat. In this manner, rectifier 70 and diodes D1, D2, D3, and D4 are not required which further reduces the cost of the filament cutback circuit 40.

Thus, although there have been described particular embodiments of the present invention of a new and useful BALLAST CIRCUIT FOR A GAS DISCHARGE LAMP THAT REDUCES A PRE-HEAT VOLTAGE TO THE LAMP FILAMENTS DURING LAMP IGNITION it is not intended that such references be construed as limitations upon the scope of this invention except as set forth in the following claims.

What is claimed is:

1. A ballast circuit for pre-heating lamp filaments in a plurality of gas-discharge lamps, comprising:

an inverter operable to convert a DC voltage into an AC voltage for powering the gas-discharge lamps;

a primary pre-heating winding coupled to the inverter to receive a pre-heat voltage related to the AC voltage;

secondary pre-heating windings that are each connectable to one of the lamp filaments, the secondary pre-heating windings being magnetically coupled to the primary pre-heating winding to receive the pre-heat voltage;

a filament cut-back circuit coupled to the primary pre-heating winding, the filament cut-back circuit being operable to reduce the pre-heat voltage after the lamp filaments have been pre-heated;

the inverter including a resonant inductor, the primary pre-heating winding being coupled to the resonant inductor;

a pre-heat capacitor coupled between the resonant inductor and the primary pre-heating winding; and the filament cut-back circuit having a filament cut-back capacitor, a capacitance of the filament cut-back capacitor being greater than a capacitance of the pre-heat capacitor so that the pre-heat voltage is reduced when the inverter is generating the AC voltage at or above a lamp ignition power level.

2. The ballast circuit of claim 1, wherein the filament cut-back circuit further comprises:

a switch including a switch gate input terminal wherein the filament cut-back circuit is operable to reduce the pre-heat voltage when the switch is in a first switch state; and a switch gate control circuit coupled to the switch gate input terminal, the switch gate control voltage being operable to cause the switch to operate in the first switch state.

3. The ballast circuit of claim 1, further comprising:

the inverter including a resonant inductor having a tap;

the switch comprising a low voltage transistor that includes the switch gate input terminal; and the primary pre-heating winding being coupled to the resonant inductor at the tap, the tap being positioned on the resonant inductor such that the switch gate control voltage is within voltage requirements of the low voltage transistor.

4. The ballast circuit of claim 3, further comprising the filament cut-back circuit including a rectifier for rectifying the switch gate control voltage having at least one low voltage diode between the switch and the primary pre-heating winding wherein the tap is positioned on the resonant inductor such that a rectified voltage associated with the pre-heat voltage is within voltage requirements of the low voltage diode.

5. A method of reducing a pre-heat voltage after lamp filaments of a plurality of lamps have been pre-heated, comprising receiving a pre-heat voltage from an inverter that powers the gas-discharge lamps utilizing a primary pre-heating winding;

coupling the pre-heat voltage to secondary pre-heating windings magnetically coupled to the primary pre-heating winding, each secondary pre-heating winding being coupled to one of the lamp filaments; and reducing the pre-heat voltage across the primary pre-heating winding after the lamp filaments have been pre-heated; and wherein reducing the pre-heat voltage across the primary pre-heating winding after the lamp filaments have been pre-heated further comprises providing a first voltage drop component coupled to the inverter and the primary pre-heat winding, providing a second voltage drop component coupled to the primary pre-heat winding such that the second voltage drop component is associated a winding voltage across the primary pre-heat winding, dropping a greater portion of a pre-heat voltage across the first voltage drop component in comparison to the second voltage drop component thereby reducing the pre-heat voltage.

6. The method of claim 5, wherein the pre-heat voltage is associated with a voltage across a resonant inductor in the inverter.

7. The method of claim 6, wherein receiving the pre-heat voltage from the inverter further comprises receiving only part of the voltage transmitted across the resonant inductor.

8. The method of claim 5, wherein reducing the pre-heat voltage across the primary pre-heating winding after the lamp filaments have been pre-heated, further comprises shorting the primary pre-heat winding.

9. The method of claim 5, wherein dropping a greater portion of a voltage of the pre-heat voltage across the first voltage drop component in comparison to the second voltage drop component further comprises opening a switch to activate the second voltage drop component.

* * * * *